US006969833B2

(12) United States Patent
Suzuki

(10) Patent No.: US 6,969,833 B2
(45) Date of Patent: Nov. 29, 2005

(54) HEATING APPARATUS AND IMAGE HEATING APPARATUS

(75) Inventor: Hitoshi Suzuki, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/864,363

(22) Filed: Jun. 10, 2004

(65) Prior Publication Data

US 2005/0006378 A1 Jan. 13, 2005

(30) Foreign Application Priority Data

Jun. 10, 2003 (JP) ..... 2003-164700

(51) Int. Cl.[7] ..... H05B 6/14; G03G 15/20

(52) U.S. Cl. ..... 219/619; 219/670; 219/663; 399/328; 399/330

(58) Field of Search ..... 219/619, 670, 219/661–668; 399/328–338

(56) References Cited

U.S. PATENT DOCUMENTS

| | | | | |
|---|---|---|---|---|
| 4,678,883 | A * | 7/1987 | Saitoh et al. | 219/645 |
| 5,464,964 | A | 11/1995 | Okuda et al. | 219/497 |
| 5,534,987 | A | 7/1996 | Ohtsuka et al. | 355/285 |
| 5,747,774 | A | 5/1998 | Suzuki et al. | 219/216 |
| 5,994,671 | A | 11/1999 | Suzuki et al. | 219/216 |
| 6,373,036 | B2 | 4/2002 | Suzuki | 219/619 |
| 6,713,734 | B2 | 3/2004 | Suzuki | 219/619 |
| 2003/0068169 | A1 | 4/2003 | Suzuki | 399/69 |

FOREIGN PATENT DOCUMENTS

| | | |
|---|---|---|
| JP | 4-166966 | 6/1992 |
| JP | 5-9027 | 1/1993 |
| JP | 10-74009 | 3/1998 |

* cited by examiner

*Primary Examiner*—Philip H. Leung
(74) *Attorney, Agent, or Firm*—Fitzpatrick, Cella, Harper & Scinto

(57) ABSTRACT

A heating apparatus includes a magnetic field generator for generating an AC magnetic field; a heat generation member for generating heat by the magnetic field generated by the magnetic field generator, the heat generation member being effective to heat a material to be heated; a magnetic field suppressing member for suppressing the magnetic field from the magnetic field generator; a moving unit for moving the magnetic field suppressing member into a gap between the magnetic field generator and a heat generating portion where the magnetic field generated by the magnetic field generator substantially acts on the heat generation member; a magnetic field controller for controlling an effective magnetic field generated by the magnetic field generator, wherein the magnetic field controller changes the magnetic field generated by the magnetic field generator in accordance with a moving operation of the magnetic field suppressing member, and wherein the effective magnetic field in a heating operation for the material to be heated is less intensive during movement of the magnetic field suppressing member than when the magnetic field suppressing member is at rest.

6 Claims, 11 Drawing Sheets

HEATING APPARATUS AND IMAGE HEATING APPARATUS

FIELD OF THE INVENTION AND RELATED ART

The present invention relates to a heating apparatus based on electromagnetic induction preferably usable as an image heating apparatus for fixing an unfixed image on recording medium, in an image forming apparatus such as a printer, a copying machine, etc.

In recent years, the energy conservation movement has been spreading even in the field of office automation. Thus, in order to conserve energy while improving an image forming apparatus in terms of startup speed, heating apparatuses employing a heating system based on electromagnetic induction have been proposed as the replacement for conventional heating apparatuses, that is, the heating apparatuses employing a heat roller which uses a halogen lamp as a heat source. Further, some of them have been put to practical use.

A heating apparatus employing a heating system based on electromagnetic induction (which hereinafter will be referred to simply as electromagnetic induction heating apparatus) comprises an electrically conductive member (electromagnetic induction heating member) as a heat generating member, which is subjected to an alternating magnetic field generated by a magnetic field generating means in order to cause the heat generating member to generate heat. More specifically, as a heat generating member is subjected to an alternating magnetic field, eddy current is generated in the electrically conductive heat generating member, and this eddy current generates heat (Joule heat), which is used for heating an object. In the case of the thermal fixing apparatus for an image forming apparatus, the object to be heated is recording medium, which is heated by the thermal fixing apparatus so that the unfixed image formed, or borne, on the recording medium is thermally fixed to the recording medium.

Patent Document 1: Japanese Patent Application Publication 5-9027

Patent Document 2: Japanese Laid-open Patent Application 4-166966

Patent Document 3: Japanese Laid-open Patent Application 10-74009

Patent Document 1 discloses a fixing apparatus of a heat roller type, in which a ferromagnetic fixation roller is heated through electromagnetic induction, making it possible to place the point of heat generation close to the fixation nip. Thus, this fixing apparatus is more efficient in fixation process than a fixing apparatus of a heat roller type, which employs a halogen lamp as the heat source.

Patent Document 2 discloses a thermal fixing apparatus of an electromagnetic induction type, which employs a fixation roller formed of film, being therefore smaller in thermal capacity.

Patent Document 3 discloses a fixing apparatus of another electromagnetic induction type, which is characterized in that it comprises a magnetic flux blocking member (magnetic field blocking member) capable of altering, in density, the distribution of active magnetic flux, in terms of the lengthwise direction the fixation roller (film). As the material for the magnetic flux blocking member, such nonmagnetic substances as copper, aluminum, silver, and the alloys thereof, the electrical conductivity of which is good enough to allow inductive current to flow through them, ferrite, the specific resistivity of which is large enough to confine magnetic flux, etc., are ideal. Further, magnetic substances such as iron or nickel can also be used as the material for the magnetic flux blocking member, as long as the heat generated in magnetic flux blocking member by the eddy current can be controlled by providing the magnetic flux blocking member with such through holes as circular holes, slits, and/or the like.

This structural arrangement disclosed in Patent Document 3 shows one of the solutions to the "excessive out-of-sheet-path temperature increase". It also discloses a method for shielding the portion of the fixation roller (film) outside the recording medium path, from the magnetic flux, by moving the magnetic flux blocking means with the use of a predetermined driving means such as a motor, a solenoid, etc.

The "excessive out-of-sheet-path temperature increase" means the phenomenon that as a sheet of recording medium (object to be heated), the width of which is less than the width of a largest sheet of recording medium processible by a fixing apparatus, is put through the fixing apparatus, the out-of-sheet-path portion, or the portion of the electrically conductive member (fixation roller) outside the path of the recording medium, becomes higher in temperature than the portion of the electrically conductive member within the path of the recording medium, because the out-of-sheet-path portion of the fixation roller is not robbed of heat by the recording medium.

The excessive out-of-sheet-path temperature increase can be prevented by the provision of such a structural arrangement as the one disclosed in Patent Document 3 that a magnetic flux blocking member can be moved to shield the portion of the electrically conductive member outside the recording medium path, from magnetic flux. However, it was discovered that this structural arrangement suffered from the following problem. That is, in the case of this structural arrangement, the magnetic flux blocking member, which is metallic member in the form of a piece of plate, is moved within the alternating magnetic field generated between a magnetic field generating member and a heating member, which is an electrically conductive member. Therefore, eddy current is generated in the magnetic flux blocking member by the magnetic field, and this eddy current acts, in combination with the magnetic field generated by the magnetic field generating member, in the direction to oppose the movement of the magnetic flux blocking member.

Further, the magnetic field generating member and magnetic flux blocking member are either attracted to each other, or repel each other. The cause of this phenomenon can be explained by the well-known Fleming s left hand rule. As this force acts on the magnetic flux blocking member, the magnetic flux blocking member comes into contact with the magnetic field generating member, or heating member (electrically conductive member), which is located in the adjacencies of the magnetic flux blocking member; the magnetic flux blocking member is prevented from smoothly moving. In other words, in the case of such a structural arrangement as that disclosed in Patent Document 3, it is possible that the magnetic flux blocking member will fail to properly move.

SUMMARY OF THE INVENTION

The present invention is made to solve the above described technical problems, and its primary object is to provide a means which is simple in control and structure, and yet, is capable of smoothly moving the magnetic flux blocking member of an image heating apparatus of an electromagnetic induction type, in particular, an image heating apparatus of an electromagnetic induction type for heating an image on recording medium.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS (Embodiment 1)

(1) Image Forming Apparatus Example

Figure 1:
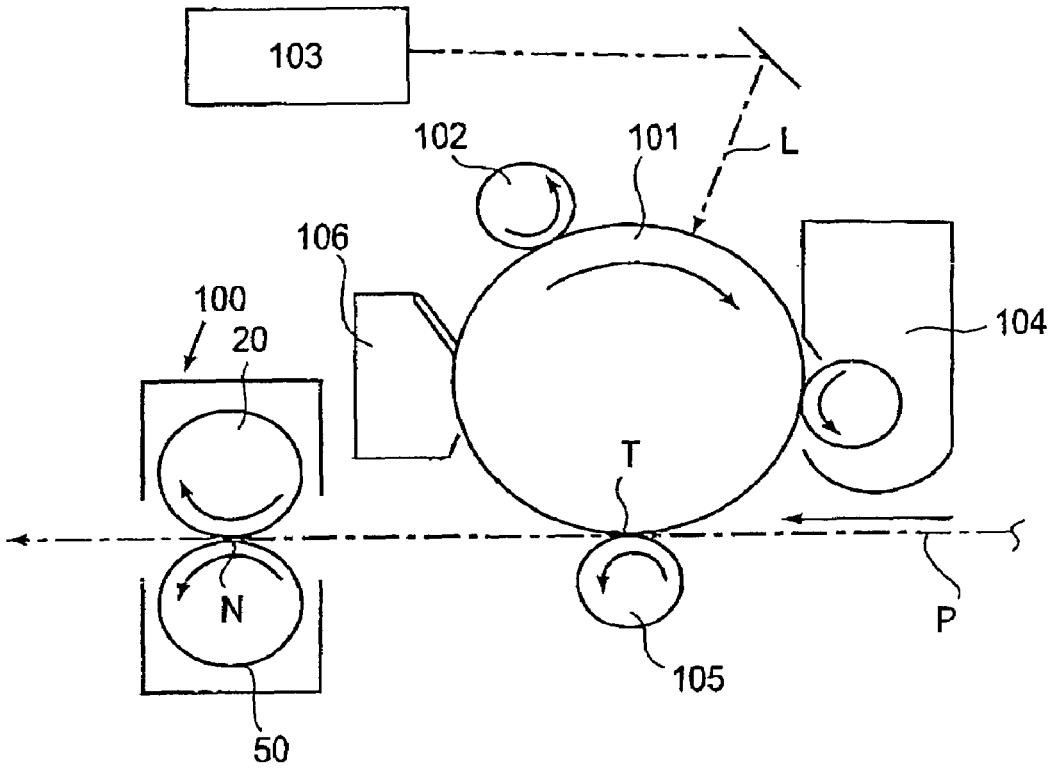
FIG. 1 is a schematic drawing of the image forming apparatus in the first embodiment of the present invention, showing the general structure thereof.

First, a typical image forming apparatus by which a heating apparatus in accordance with the present invention is employed will be described. FIG. 1 is a schematic drawing of the image forming apparatus in the first embodiment of the present invention, showing the general structure thereof. The image forming apparatus in this embodiment is provided with one of the heating apparatuses of an electromagnetic induction type in accordance with the present invention, as a thermal image heating apparatus. It is a laser printer which uses one of the electrophotographic processes of a transfer type.

Designated by a referential number 101 is an electrophotographic photosensitive member (which hereinafter will be referred to as photosensitive drum) in the form of a rotational drum. It is rotationally driven at a predetermined peripheral velocity in the clockwise direction indicated by an arrow mark in the drawing.

Designated by a referential number 102 is a charge roller as a charging means, which uniformly charges the peripheral surface of the photosensitive drum 101 to predetermined polarity and potential level as the photosensitive drum 101 is rotated.

Designated by a referential number 103 is a laser scanner, which outputs a beam L of laser light, while modulating it with sequential, digital, and electrical signals reflecting the image formation data, in such an oscillating fashion that the uniformly charged peripheral surface of the photosensitive drum 101 is scanned by the beam L of laser light as the photosensitive drum 101 is rotated. As a result, an electrostatic latent image, which reflects the image formation data, is formed on the peripheral surface of the photosensitive drum 101.

Designated by a referential number 104 is a developing apparatus, which normally or reversely develops the electrostatic latent image on the peripheral surface of the photosensitive drum 101 into an image formed of toner (which hereinafter will be referred simply as toner image).

A referential number 105 designates a transfer roller as a transferring means, which is kept in contact with the photosensitive drum 101 with the application of a predetermined amount of pressure, forming thereby a transfer nip T, through which a sheet P of recording medium delivered thereto by an unshown sheet feeding mechanism with a predetermined timing is conveyed while remaining pinched between the photosensitive drum 101 and transfer roller 105. As the recording medium P is conveyed through the transfer nip T, a predetermined transfer bias is applied to the transfer roller 105 with a predetermined timing. As a result, the toner image on the peripheral surface of the photosensitive drum 101 is electrostatically transferred, in a manner of being peeled away from the peripheral surface of the photosensitive drum 101 from one end to the other, onto the surface of the recording medium P, while the recording medium P is conveyed, remaining pinched by the transfer roller 105 and photosensitive drum 101, through the transfer nip T.

After coming out of the transfer nip T, the recording medium P is separated from the peripheral surface of the photosensitive drum 101, and is introduced into the thermal image fixing apparatus 100. As the recording medium P is introduced into the thermal image fixing apparatus 100, and conveyed through the apparatus, the unfixed toner image on the recording medium P is thermally fixed to the recording medium P; the toner image is turned into a permanent image. Thereafter, the recording medium P is discharged from the thermal image fixing apparatus.

Designated by a referential number 106 is a device for cleaning the photosensitive drum 101, which removes the toner remaining on the peripheral surface of the photosensitive drum 101 after the separation of the recording medium P from the peripheral surface of the photosensitive drum 101. After the removal of the toner remaining of the peripheral surface of the photosensitive drum 101, that is, the cleaning of the peripheral surface of the photosensitive drum 101, the peripheral surface of the photosensitive drum 101 is used again for image formation.

(2) Thermal Image Heating Apparatus 100

Figure 2:
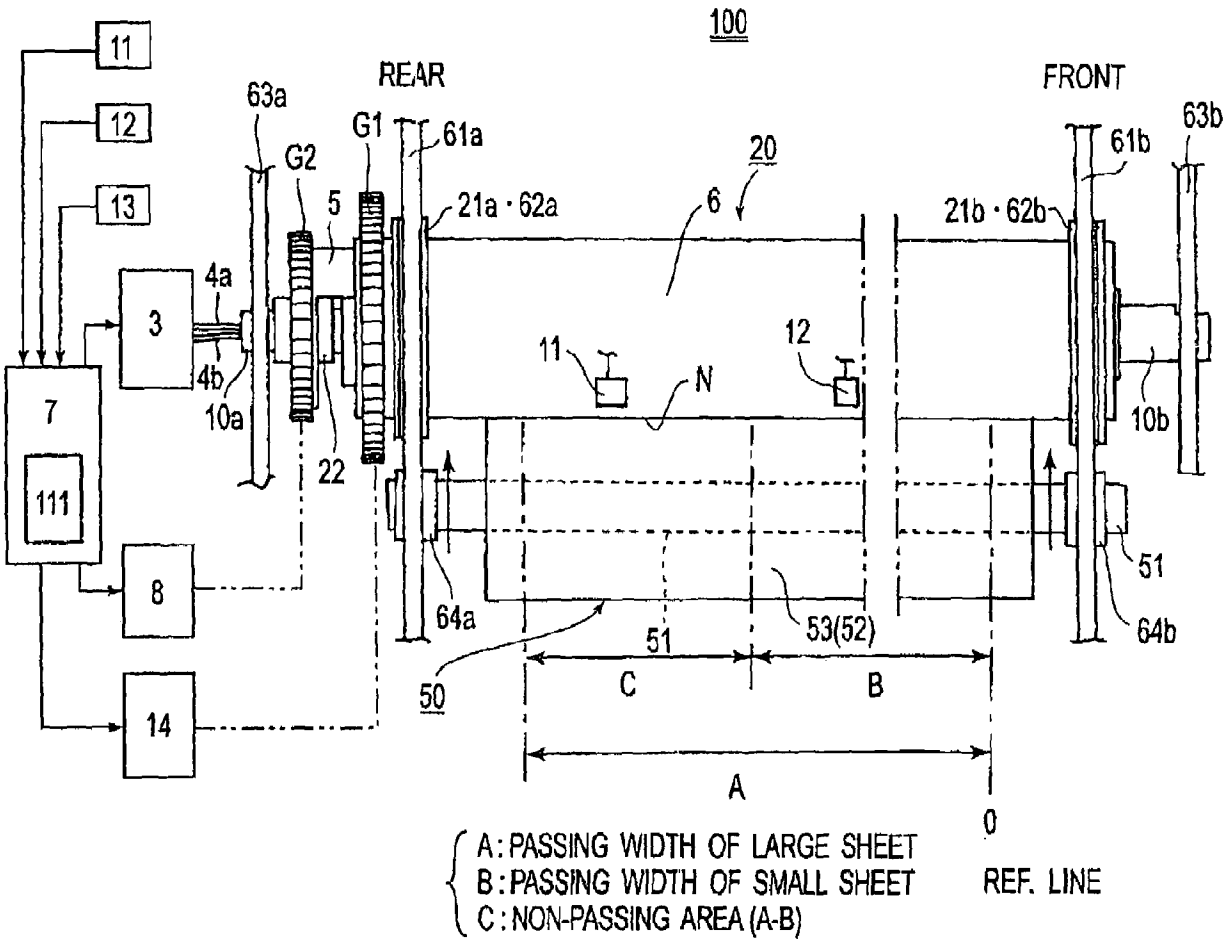
FIG. 2 is a schematic front view of the thermal image fixing apparatus in the first embodiment of the present invention, in which some portions of the apparatus are not shown.
Figure 3:
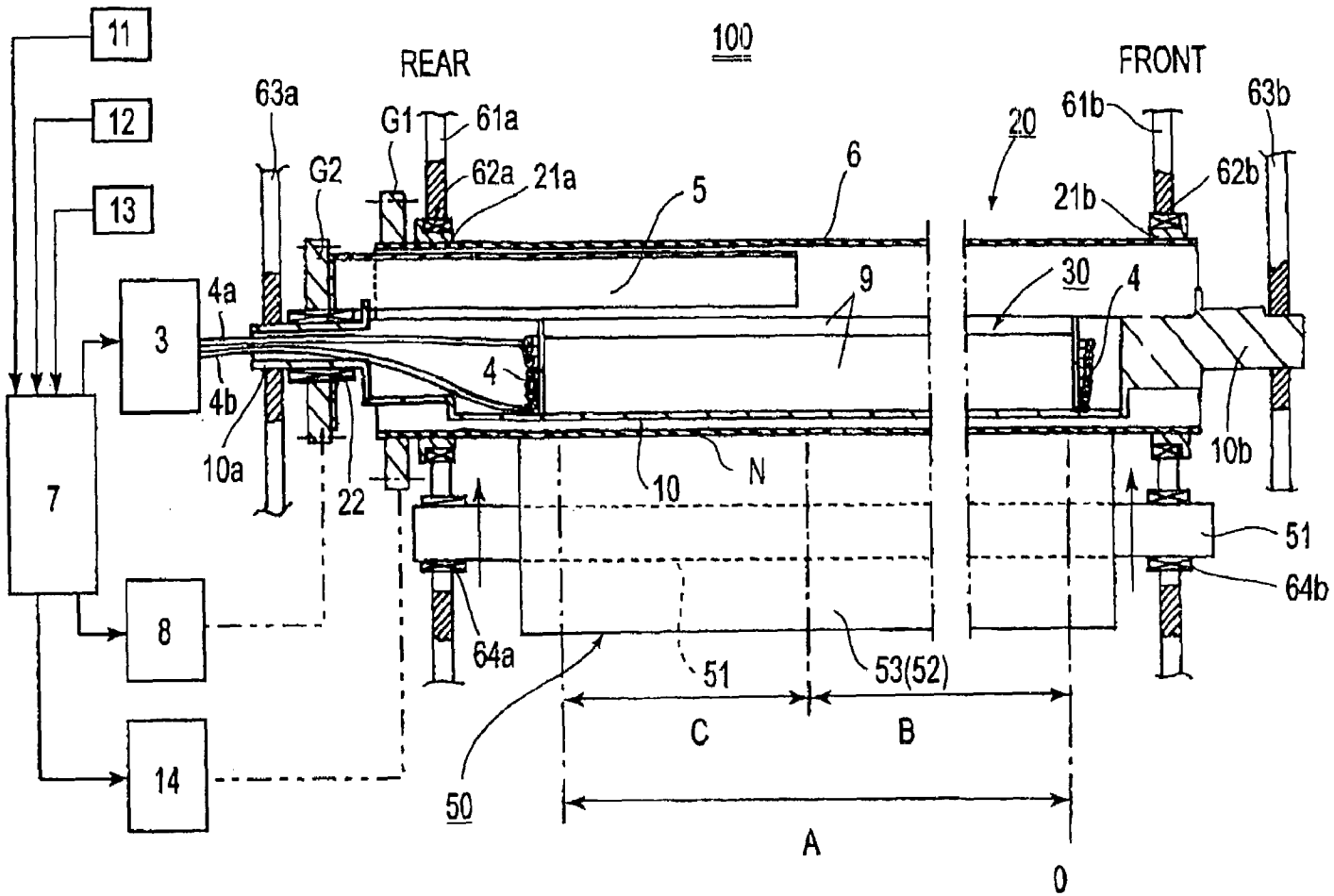
FIG. 3 is a partially broken schematic view of the thermal image fixing apparatus shown in FIG. 2.

The thermal image heating apparatus 100 in this embodiment is a heating apparatus of an electromagnetic induction type in accordance with the present invention. FIG. 2 is a schematic front view of this thermal image heating apparatus, in which some portions of the apparatus are not shown. FIG. 3 is a partially broken schematic view of the same thermal image fixing apparatus as the one in FIG. 2. FIG.

Figure 4:
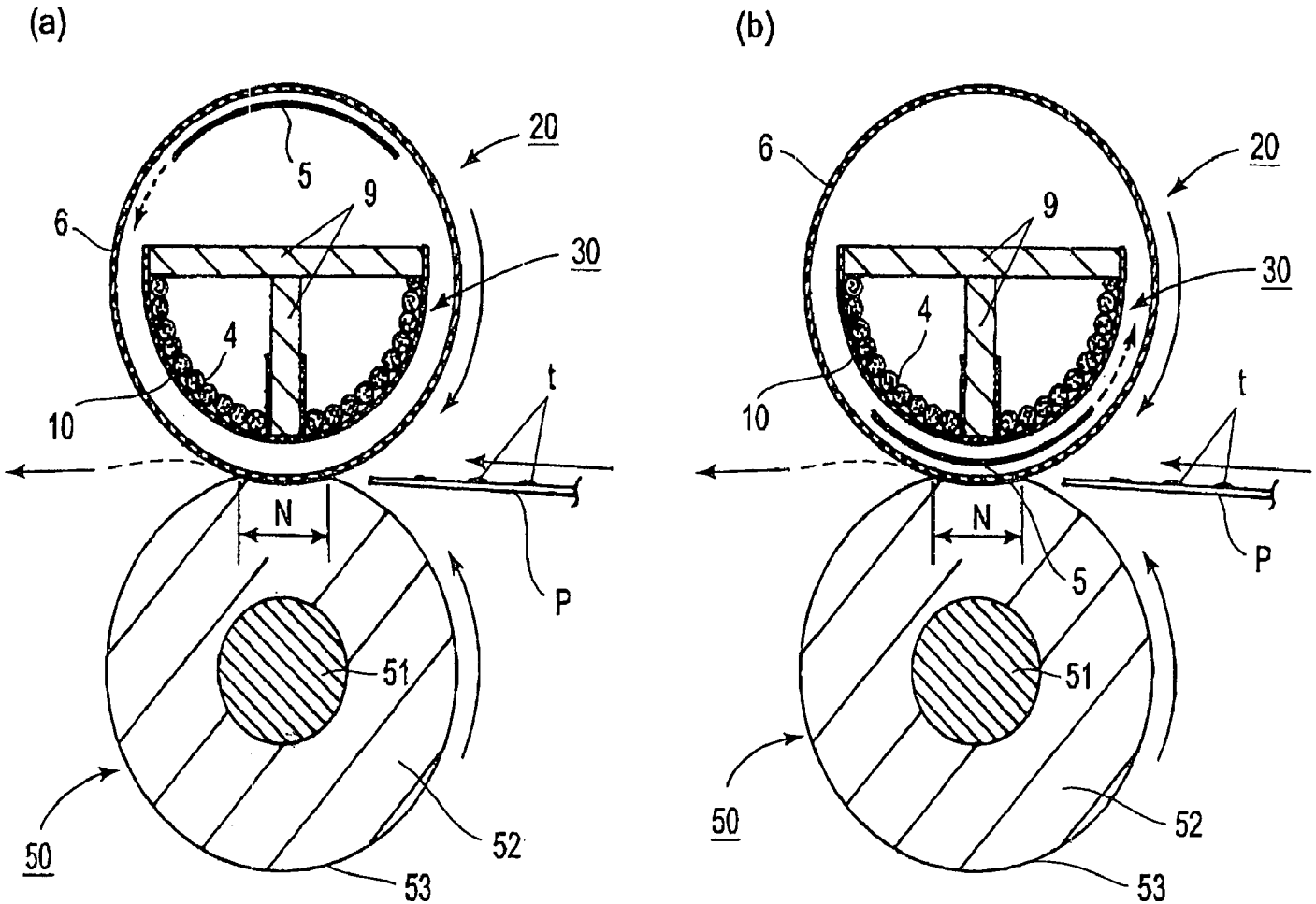
FIG. 4(*a*) is a schematic cross-sectional view of the essential portion of the thermal image fixing apparatus shown in FIG. 2, in which the magnetic flux blocking member is in the first position, and FIG. 4(*b*) is a schematic cross-sectional view of the essential portion of the thermal image fixing apparatus in FIG. 2, in which the magnetic flux blocking member is in the second position.
Figure 5:
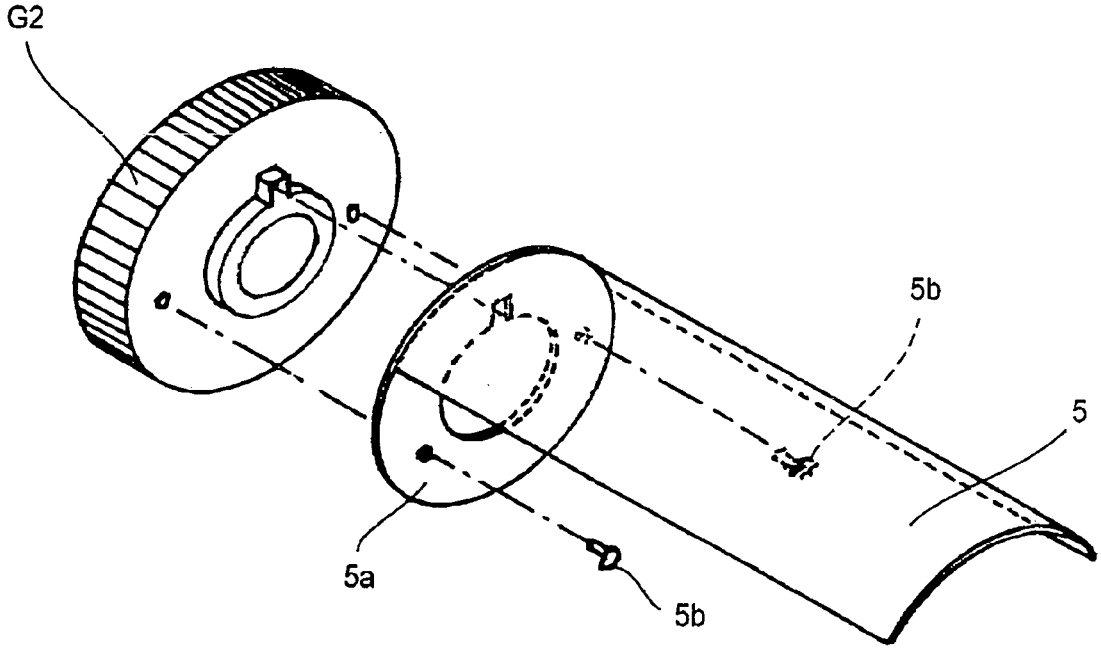
FIG. 5 is an external perspective view of the magnetic flux blocking member.
Figure 6:
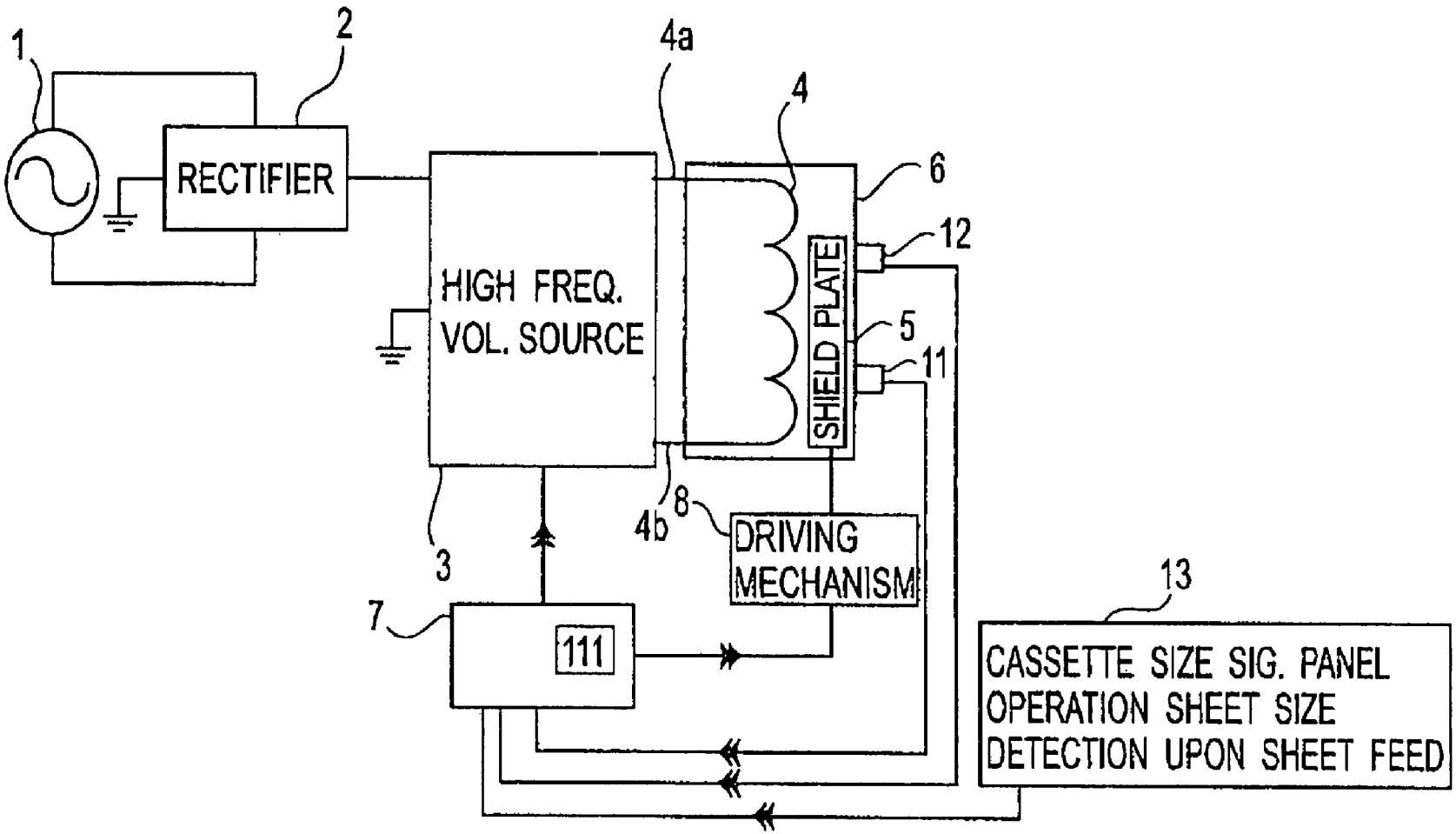
FIG. 6 is a block diagram of the control system.

4(*a*) is a schematic cross-sectional view of the essential portion of the same thermal image heating apparatus, in which the magnetic flux blocking member, as a member for shielding the fixation roller 6 as a heat generating member, from the magnetic field generated by the exciter coil assembly 30, is in the first position, and FIG. 4(*b*) is a schematic cross-sectional view of the essential portion of the same thermal image heating apparatus, in which the magnetic flux blocking member is in the second position. FIG. 5 is an external perspective view of the magnetic flux blocking member, and FIG. 6 is a block diagram of the control system.

A referential number 20 designates a fixation roller assembly as a first fixing member, and a referential number 50 designates a pressure roller as a second fixating member. The first and second fixing members 20 and 50 are vertically stacked in parallel so that their peripheral surfaces are kept pressed against each other to form the fixation nip N.

The fixation roller assembly 20 comprises a fixation roller 6 (heating member), and the exciter coil assembly 30. The fixation roller 6 is an electrically conductive member, and is cylindrical and hollow. The exciter coil assembly 30 is a magnetic field generating means, and is located in the hollow of the fixation roller 6.

The fixation roller 6 is formed of a ferromagnetic substance, for example, nickel, iron, ferromagnetic SUS, nickel-cobalt alloy, etc. It is in the form of a hollow cylinder, the wall of which is relatively thin (in the range of 200 $\mu$m–1 mm). Its wall is single-layered (metallic layer), or multilayered (inclusive of metallic layer). The fixation roller 6 is provided with a pair of slippery rings 21*a* and 21*b* fitted around the front and rear end portions of the fixation roller 6. The fixation roller 6 is rotationally supported by these slippery rings 21*a* and 21*b*, by the bearings 62*a* and 62*b*, with which the main lateral walls 61*a* and 61*b*, that is, the front and rear lateral plates, of the fixing apparatus, are provided, respectively.

The exciter coil assembly 30 as a magnetic field generating means placed in the hollow of the fixation roller 6 is an assembly comprising a holder 10 (external housing), an exciter coil 4, a magnetic core 9, a magnetic flux blocking member 5, etc. The exciter coil 4 and magnetic core 9 are held within the hollow of the holder 10, and, the magnetic flux blocking member 5 is rotatably attached to the rear end portion of the holder 10. Further, the exciter coil assembly 30 is non-rotationally supported, at a predetermined angle, by the rear and front end portions 10*a* and 10*b* of the holder 10, by a pair of subsidiary lateral plates 63*a* and 63*b* of the fixing apparatus, located outward of the rear and front main lateral plates 61*a* and 61*b* of the fixing apparatus, with the provision of a predetermined gap between the internal surface of the fixation roller 6 and magnetic flux blocking member 5.

The pressure roller 50 as a second fixing member comprises a metallic core 51, a heat resistant elastic layer 52, and a surface layer 53 for facilitating the release of recording medium from the pressure roller 50. It is placed under the above described fixation roller assembly 20, in parallel to the fixation roller 6, being rotatably supported by the rear and front portions of its metallic core 51, by the rear and front main plates 61*a* and 61*b*, with the interposition of the bearings 64*a* and 64*b*, respectively. The bearings 64*a* and 64*b* are held by the main lateral plates 61*a* and 61*b*, being enabled to move toward or away from the fixation roller 6. More specifically, the bearings 64*a* and 64*b* are kept pressed upward by a pressing means such as a pair of compression springs or the like, so that the pressure roller 50 is kept pressed on the underside of the peripheral surface of the fixation roller 6, against the elasticity of its elastic layer 52, by the predetermined amount of pressure generated by the pressing means, forming thereby the fixation nip N (heating nip).

Designated by an alphanumeric referential symbol G1 is a fixation roller drive gear, which is solidly fitted around the rear end portion of the fixation roller 6. As driving force is transmitted to this gear G1 from a first driving power source 14, the fixation roller 6 is rotationally driven at a predetermined peripheral velocity in the clockwise direction indicated in FIG. 4. As the fixation roller 6 is rotationally driven, the pressure roller 50 is rotated by the torque transmitted to the pressure roller 50 from the fixation roller 6 by the friction between the two rollers in the fixation nip N.

The holder 10 of the exciter coil assembly 30 comprises a holder proper, or the semicylindrical center portion, in terms of the lengthwise direction thereof, and the front and rear end portions 10*a* and 10*b*, which are substantially smaller in cross section than the holder proper. The radius of the semicylindrical center portion is slightly smaller than the internal radius of the fixation roller 6. Within the hollow of the semicylindrical holder proper of the holder 10, the exciter coil 4 and magnetic core 9 are held. The rear end portion 10*a* of the holder 10 is cylindrical, and this cylindrical portion 10*a* of the holder 10 is inserted in the round hole of the subsidiary lateral plate 63*a*, on the rear side, of the fixing apparatus, supporting thereby the front end of the exciter coil assembly 30 by the subsidiary lateral plate 63*a*. The front end portion 10*b* of the holder 10 is also cylindrical, except for the very end which is given the D-shaped cross section. This very end portion of the front end portion 10*b* of the holder 10 is inserted in the D-shaped hole of the subsidiary lateral plate 63*b*, on the front side, of the fixating apparatus, supporting thereby the front end of the exciter coil assembly 30. Thus, the holder 10, which is holding the exciter coil assembly 30, is non-rotationally supported between the rear and front subsidiary plates 63*a* and 63*b*, in such an attitude that the external surface of the holder 10 faces downward, with the presence of the predetermined gap between the external surface of the holder 10 and the internal surface of the fixation roller 6.

The holder 10 in this embodiment is molded of a material made up by mixing glass fiber into PPS resin which is heat resistant and is provided with mechanical strength. Obviously, it is nonmagnetic. As the material for the holder 10, such nonmagnetic substances as PPS resin, PEK resin, polyimide resin, polyamide resin, polyamide-imide resin, ceramics, liquid polymers, fluorinated resins, etc., are ideal.

The exciter coil 4 must be capable of generating an alternating magnetic flux strong enough for heating. In order to achieve this objective, it must be lower in resistivity and higher in inductance. In this embodiment, a piece of litz wire made up of roughly 80–160 fine strands (0.1–0.3 mm in diameter) woven together, is employed as the wire for the exciter coil 4. The fine wires are coated with electrically insulating substance. The exciter coil 4 in this embodiment comprises a core 9, and the litz wire wounded 8–12 times around the core 9 in such a manner that it conforms to the internal contour of the holder 10, which resembles an elongated boat. Designated by referential symbols 4*a* and 4*b* are two lead wires extended outward from the exciter coil 4, through the cylindrical rear end portion 10*a* of the holder 10 and connected to a high frequency power source 3.

The magnetic core 9 is a piece of plate formed of such a magnetic substance as ferrite or Permalloy used as the core of a transformer. In this embodiment, the magnetic core 9 is placed at the center of the exciter coil 4. It is the combination of two pieces of magnetic plate, the lengths of which match the width A of a largest sheet of recording medium processible by the fixing apparatus. More specifically, it comprises a vertical portion in the form of a long and narrow rectangular parallelepiped, and a horizontal portion which also is in the form of a long and narrow rectangular parallelepiped, being connected to the horizontal portion in such a manner that the cross-section of the combination of the two portion form a letter T.

Designated by a referential symbol G2 is a gear as a means for moving the magnetic flux blocking member to a predetermined position in which the magnetic flux blocking member can block the magnetic flux. The magnetic flux blocking member drive gear G2 is on the inward side of the rear subsidiary plate 63*a* of the fixing apparatus, being rotatably fitted around the cylindrical rear end portion 10*a* of the holder 10, with a bearing 22 interposed between the gear G2 and cylindrical rear end portion 10*a*.

To the internal surface of this gear G2, the magnetic flux blocking member 5 for preventing the excessive "out-of-sheet-path" temperature increase is attached so that the magnetic flux blocking member 5 extends inward of the fixation roller 6 through the rear opening of the fixation roller 6. FIG. 5 is an external perspective view of this magnetic flux blocking member 5. The magnetic flux blocking member 5 is a piece of long and narrow thin plate, which is straight in terms of the lengthwise direction of the fixation roller 6, and is arcuate in terms of the circumferential direction of the fixation roller 6. It is provided with a flange 5*a*, which is located at the rear end of the magnetic flux blocking member 5, and by which the magnetic flux blocking member 5 is solidly attached to the inward surface of the magnetic flux blocking member drive gear G2 with the use of a pair of small screws 5*b*. The material for the magnetic flux blocking member 5 is a substance such as an alloy of aluminum, copper, magnesium, or the like, which is a nonmagnetic good conductor of electricity.

As driving force is transmitted to the magnetic flux blocking member drive gear G2 from a second driving power source 8 as a means for moving the magnetic flux blocking member 5, the gear G2 is rotated, causing thereby the magnetic flux blocking member 5 solidly attached to the gear G2 to rotate along the internal surface of the fixation roller 6.

In this embodiment, while the recording medium P is conveyed through the fixing apparatus 100, its position relative to the fixing apparatus, in terms of the direction perpendicular to the recording medium conveyance direction, is controlled with reference to one of the two edges of the recording medium P parallel to the recording medium conveyance direction. Referring to FIGS. 2 and 3, a referential number 0 designates the referential line, along which the recording medium P is guided by the aforementioned one of the two edges of the recording medium P, and which is set up on the front side of the fixing apparatus. Designated by a referential symbol A is the path (range) of a recording medium of the largest width processible by the fixing apparatus. Thus, when a recording medium of this size is processed by the fixing apparatus, the excessive "out-of-paper path" temperature increase does not occur. Designated by a referential symbol B is the path (range) of a recording medium smaller in width than a recording medium of the largest width. Designated by a referential symbol C is the out-of-sheet-path range, that is, the range across which a recording medium is not conveyed when the recording medium is of a size smaller than the largest size. In other words, the range C is the difference between the ranges A and B. The actual magnetic flux blocking portion of the above described magnetic flux blocking member 5 is made to match the length of the range C, in terms of the lengthwise direction of the fixation roller 6, in order to cover the portion of the magnetic flux blocking member 5 corresponding to the range C, that is, the range across which a recording medium does not pass.

Referring to FIG. 4(*a*), normally, the magnetic flux blocking member 5 is kept in a first position, or the home position, which is on the top side of the fixation roller 6, that is, the opposite side of the fixation roller 6 from the exciter coil assembly 30. This first position is where the magnetic flux blocking member 5 has virtually no effect upon the magnetic field generated by the exciter coil assembly 30.

Designated by referential numbers 11 and 12 are first and second temperature sensors, such as a thermistor, as a means for detecting the temperature of the heating member. The first temperature sensor 11 detects the temperature of the portion of the fixation roller corresponding to the out-of-paper-path range C, and inputs the detected temperature date into a control circuit 7, whereas the second temperature sensor 12 detects the temperature of the portion of the fixation roller corresponding to the path B of a smaller recording paper, that is, the range across which both a recording medium of the largest width and a recording medium of a smaller width pass, and inputs the detected temperature data into the control circuit 7.

The control circuit 7 activates the first driving power source 14 in response to a fixing apparatus drive start signal, based on the operational sequence of the printer. As a result, the driving force from the first driving power source 14 is transmitted to the fixation roller drive gear G1, rotationally driving thereby the fixation roller 6 at the predetermined peripheral velocity in the clockwise direction indicated in FIG. 4. With this rotational driving or the fixation roller 6, the pressure roller 50 is rotated by the torque transmitted thereto by the friction between the fixation roller 6 and pressure roller 50, in the fixation nip N.

Further, the control circuit 7, as a means for controlling electrical power, flows high frequency current to the exciter coil 4 of the exciter coil assembly 30 from the high frequency power source 3 (exciter circuit) as a means for supplying the exciter coil 4 with electricity. Meanwhile, the magnetic flux blocking member 5 is kept in the first position, or the home position, as shown in FIG. 4(*a*). Referring to FIG. 6, designated by a referential number 1 is an AC input (commercial AC power source), and designated by a referential number 2 is a rectifying circuit, into which the alternating current, the frequency of which is the range of 50–60 Hz, is inputted through the AC input, being thereby rectified, and from which the rectified current is supplied to the high frequency power source 3, in which the current is converted into high frequency current, the frequency of which is in the range of 10–500 kHz. As the high frequency current is supplied to the exciter coil 4 from the high frequency power source 3, a magnetic field (high frequency wave magnetic field) is generated around the exciter coil 4. More specifically, the magnetic field is generated mainly on the semicylindrical holder side of the exciter coil assembly 30. Therefore, the magnetic field affects the bottom half of the fixation roller 6, which the external surface of the semicylindrical holder 10 closely faces. As a result, heat (Joule heat) is generated through electromagnetic induction (heat is generated by eddy current induced by magnetic field), essentially in the bottom half of the fixation roller 6, across the entire range of the fixation roller 6, which corresponds in length to the entire range of the path of a recording medium of the largest width. Then, the surface temperature of the fixation roller 6 is made uniform, in terms of the circumferential direction of the fixation roller 6, by the rotation of the fixation roller 6.

This temperature increase of the fixation roller 6 resulting from the heat generated by electromagnetic induction is detected by the first and second temperature sensors 11 and 12, and the detected temperature data are inputted into the control circuit 7. The temperature of the fixation roller 6 is controlled by controlling the amount of electricity supplied to the exciter coil 4 from the high frequency power source 3, so that the temperature level of the fixation roller 6 detected by the second temperature sensor 12 and inputted into the control circuit 7 as a temperature controlling means remains at a predetermined temperature level optimal for image fixation.

While the temperature of the fixation roller 6 is controlled as described above, the recording medium P, which is bearing an unfixed toner image t, is introduced into the fixation nip N from the direction of the image forming means, and is conveyed through the fixation nip N while remaining pinched by the fixation roller 6 and pressure roller 50. While the recording medium P is conveyed through the fixation nip N, the unfixed toner image t on the recording medium P is permanently fixed to the surface of the recording medium P by the heat from the fixation roller 6 and the pressure in the fixation nip N.

When a recording medium P fed into the fixing apparatus is smaller in width than a recording medium P of the largest width processible by the fixing apparatus, the portion of the fixation roller 6, which corresponds to the out-of-sheet-path range C, is not robbed of heat, becomes higher in temperature than the portion of the fixation roller, which corresponds to the path (range) B of the recording medium P of the smaller size, and the temperature of which is maintained at the predetermined level optimal for image fixation; in other words, the excessive out-of-sheet-path temperature increase occurs. Further, the greater the number of the continuously red recording mediums of the smaller size, the greater the excessive out-of-sheet-path temperature increase.

The first temperature sensor 11 detects the temperature of the portion of the fixation roller 6, which corresponds to the out-of-sheet-path range C, and as the temperature level of the portion of the fixation roller 6, corresponding to the out-of-sheet-path range C, detected by this first temperature sensor 11 reaches a predetermined excessive level, the control circuit 7 activates the second driving power source 8 to drive in steps the magnetic flux blocking member drive gear 180°, moving the magnetic flux blocking member 5 from the first position in FIG. 4(*a*) to the second position in FIG. 4(*b*), and retains it in the second position. This second position for the magnetic flux blocking member 5 is where the magnetic flux blocking member 5 is interposed between the exciter coil assembly 30 and the internal surface of the fixation roller 6, shielding thereby the portion of the fixation roller 6, corresponding to the out-of-sheet-path range C, from the magnetic field generated by the exciter coil assembly 30. In other words, in order to shield the portion of the fixation roller, in which heat is actually generated, from the magnetic field, the magnetic flux blocking member 5 is placed in the gap between the exciter coil 4 and the heat generating member (portion of fixation roller, in which heat is actually generated), as shown in FIG. 4. By structuring the fixing apparatus so that the magnetic flux blocking member 5 can be moved, as described above, to shield the portion of the fixation roller, corresponding to the out-of-sheet-path range C, from the magnetic field, heat generation in the portion of the fixation roller, corresponding to the out-of-sheet-path range C, can be prevented to prevent the excessive out-of-sheet-path temperature increase.

In this embodiment, the magnetic flux blocking member 5 is moved in response to the temperature level of the fixation roller 6 detected by the temperature sensors. However, this embodiment is not intended to limit the scope of the present invention. In other words, in order to move the magnetic flux blocking member 5, the aforementioned means for moving the magnetic flux blocking member 5 may be activated in accordance with at least one factor among the size of an object to be heated, the number of the object, in the form of a sheet, continuously fed into a heating apparatus and smaller in width than the width of an object of the largest width processible by the heating apparatus, and the length of time objects of the smaller width are continuously fed into the heating apparatus.

However, when moving the magnetic flux blocking member 5 into the second position, there occurs the following problem as described before. That is, the magnetic flux blocking member 5, which is to be moved into the magnetic field formed between the exciter coil assembly 30 and the fixation roller 6 as an electrically conductive member, is metallic. Therefore, as the magnetic flux blocking member 5 is moved into the magnetic field, eddy current is induced in the magnetic flux blocking member 5, and electromagnetic force is induced by this eddy current and magnetic field, attracting the magnetic flux blocking member 5 toward the exciter coil 4 or repelling the magnetic flux blocking member 5 away from the exciter coil 4. This phenomenon is explainable by the well-known Fleming s left hand rule. As this electromagnetic force is induced, the magnetic flux blocking member 5 is made by the electromagnetic force to come into contact with the holder 10 of the exciter coil assembly 30 located very close to the magnetic flux blocking member 5, or the internal surface of the fixation roller 6 located also very close to the magnetic flux blocking member 5, being thereby prevented from being smoothly moved.

Figure 7:
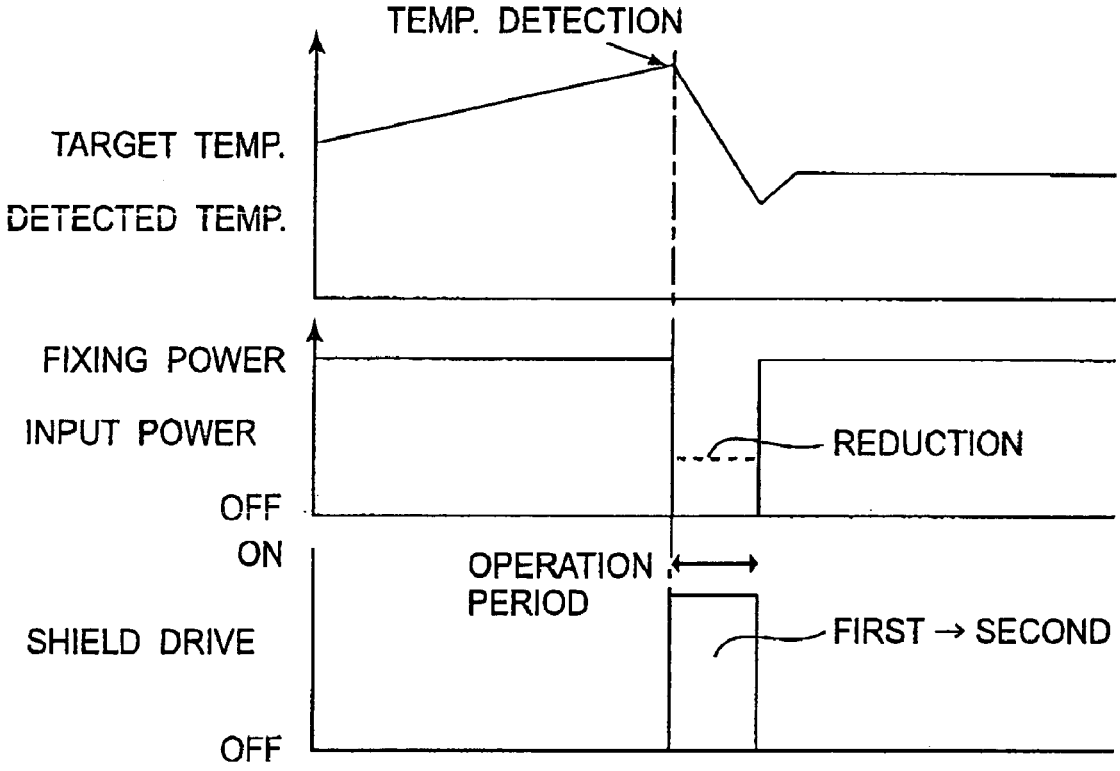
FIG. 7 is the operational sequence of the magnetic flux blocking member.

In this embodiment, therefore, the magnetic flux blocking member 5 is moved following the operational sequence for moving the magnetic flux blocking member 5 shown in FIG. 7. That is, before moving the magnetic flux blocking member 5 (magnetic flux blocking movement), the power input to the exciter coil assembly 30 is temporarily reduced to a level lower than the level optimal for image fixation, or temporarily stopped. Then, the magnetic flux blocking member 5 is moved while the power input to the exciter coil assembly 30 is kept at the reduced level, or no power is supplied to the exciter coil assembly 30. In other words, the magnetic flux blocking member 5 is moved while the magnetic filed generated by the exciter coil assembly 30 is kept at a weakened level, or no magnetic field is generated by the exciter coil assembly 30. This procedure characterizes this embodiment of the present invention.

More specifically, as the temperature level of the portion of the fixation roller 6, corresponding to the out-of-sheet-path range C, detected and inputted into the control circuit 7 by the first temperature sensor 11 for detecting the portion of the fixation roller 6, corresponding to the out-of-sheet-path range C, reaches the predetermined excessive level, the control circuit 7, which also serves as a power supply controlling means, temporarily reduces the amount by which power is supplied to the exciter coil 4 of the exciter coil assembly 30 from the high frequency power source 3, to a level lower than the level (fixation level) optimal for image fixation, that is, the level at which the magnetic flux blocking member is not moved, or temporarily stop supplying the exciter coil 4 with electric power, and then, it activates the second driving power source 8 to rotate in steps the magnetic flux blocking member drive gear G2 180°, moving thereby the magnetic flux blocking member 5 from the first position in FIG. 4(*a*) to the second position in FIG. 4(*b*), to retain the magnetic flux blocking member 5 in the second position. After moving the magnetic flux blocking member 5 into the second position, the control circuit 7 restores the electric power inputted to the exciter coil 4 of the exciter coil assembly 30 from the high frequency power source 3, to the level optimal for image fixation.

Then, the fixation roller 6 is heated again through electromagnetic induction, while the power supply to the exciter coil 4 from the high frequency power source (high frequency converter 3) is controlled by the temperature control circuit 7 in response to the outputs of the temperature sensors (temperature detecting means) 11 and 12, in order to keep the temperature of the fixation roller 6 at the predetermined level optimal for image fixation. More specifically, as the temperature control circuit 7 determines that the difference between the outputs (temperature levels) of the temperature sensors 11 and 12, and the predetermined temperature level optimal for image fixation is greater than a predetermined value, it executes such a control that causes the high frequency converter 3 to supply the exciter coil 4 with alternating current with a lower frequency, whereas as the temperature 7 determines that the difference between the outputs (temperature levels) of the temperature sensors 11 and 12, and the predetermined temperature level optimal for image fixation is less than a predetermined value, it execute such a control that causes the high frequency converter 3 to supply the exciter coil 4 with alternating current with a higher frequency. However, if the temperature control circuit 7 determines that the outputs (temperature levels) of the temperature sensors 11 and 12 are higher than the predetermined temperature level ideal for image fixation, it executes such a control that causes the high frequency converter 3 to stop supplying the exciter coil 4 with power (alternating current).

The method for controlling the fixation roller temperature does not need to be limited to the above described one. For example, the temperature of the fixation roller may be kept at a predetermined level by turning on or off the power supply to the exciter coil 4 while keeping the power (frequency) constant.

In this embodiment, the strength of the magnetic field generated by the coil 4 is reduced only when it is necessary to move the magnetic flux blocking member. Therefore, the magnetic flux blocking member of the heating apparatus in this embodiment can be better prevented from being unsatisfactorily moved than that of a fixing apparatus in accordance with the prior art. As one of the examples of the method for changing the strength of the magnetic field, the target temperature for the fixation roller 6 is changed in order to change the amount of current flowed to the coil.

Another example of the method for controlling the magnetic field is to control the power supplied to the exciter coil 4. The power supply to the coil 4 can be changed by changing the frequency of the high frequency current. Further, the magnetic field can be changed by the changing the current supplied to the exciter coil 4, or the voltage applied to the exciter coil 4.

As described above, according to this embodiment of the present invention, while the magnetic flux blocking member 5 is moved, the amount by which current is supplied to the exciter coil 4 of the exciter coil assembly 30 is kept temporarily reduced, or the power supply to the exciter coil 4 is temporarily stopped, in order to prevent the magnetic flux blocking member 5 from being electromagnetically pulled or repelled. In other words, the magnetic flux blocking member 5 is moved under the condition in which there is no electromagnetic force which interferes with the movement of the magnetic flux blocking member 5. Therefore, the magnetic flux blocking member 5 can be smoothly moved.

For the following reason, the employment of an ordinary motor as a part of the mechanism for moving the magnetic flux blocking member makes it possible to reduce the amount of the torque necessary to move the magnetic flux blocking member. That is, in order to move the magnetic flux blocking member while it is affected by the electromagnetic force, the amount of the torque necessary to move the magnetic flux blocking member must be large enough to compensate for the effect of the electromagnetic force. Therefore, the motor large enough to compensate for the effect of the electromagnetic force must be employed to move the magnetic flux blocking member. Thus, consideration must be made in the design of the power supply for the motor for moving the magnetic flux blocking member so that the power supply is provided with surplus capacity for supplying the motor with the additional amount of current necessary to compensate for the effect of the electromagnetic force. Further, the starting current, which is peculiar to a motor, and is several time larger than the steady-state current, must be taken into consideration. In addition, the increase in motor size results in such problems that the larger the motor, the greater the loss, that is, the less the efficiency, or that the larger the motor, the greater the space it requires.

Moreover, in consideration of the transient control which must be executed to inductively heating the fixation roller while the magnetic flux blocking member is moved, the impedance seen from the coil side continuously changes, because, while the magnetic flux blocking member is moved, an object (magnetic flux blocking member) complicated in shape continuously moves in the magnetic field, and also, because the fixation roller and magnetic flux blocking member are different in the values of physical properties. As seen from the driving power source side, it seems as if the values of the physical properties continuously change, due to the effect of the magnetic field generated by the eddy current in the magnetic flux blocking member, in the same manner as the electromagnetic force induced by the magnetic field generated by the eddy current induced in the magnetic flux blocking member, and the magnetic force induced by the magnetic field generated by the current flowed through the coil, affect each other, when the magnetic flux blocking member formed of a substance high in electrical conductivity is employed. This is related to the shape of the magnetic flux blocking member, the distances from the magnetic flux blocking member to the adjacent components, etc. These phenomena are difficult to control when heat is generated by the eddy current electromagnetically induced by high frequency current. Therefore, in order to reliably control the fixing apparatus, the power supply to the exciter coil should be temporarily reduced, or temporarily stopped.

As for the control of the power supply to the exciter coil 4 of the exciter coil assembly 30 from the high frequency power source 3 as an electric power supplying means, if the electric power supply to the exciter coil 4 is reduced, instead of being stopped, the amount by which the temperature of the fixation roller reduces is smaller. Therefore, from the standpoint of fixation performance, reducing the power supply to the exciter coil 4 is advantageous to the completion shutdown of the power supply to the exciter coil 4. On the other hand, the complete shutdown is advantageous to the reduction of the power supply to the exciter coil 4, because the complete shutdown makes it possible to more reliably move the magnetic flux blocking member 5.

In this embodiment, the excessive temperature level of the portion of the fixation roller corresponding to the out-of-sheet-path range C is detected by the first temperature sensor 11, and the electric power supplied to the exciter coil 4 is temporarily reduced, or completely shut down. Then, while the electric power supply to the exciter coil 4 is kept at the reduced level, or completely shut down, the magnetic flux blocking member 5 is moved. The adoption of an operational sequence such as the above described one makes it possible to constantly control the amount of the electric power supplied by the high frequency power source 3, in response to the temperature level of the fixation roller 6 detected by the first temperature sensor 11, so that the magnetic flux blocking member 5 can be smoothly moved.

In this embodiment, in response to the fixing apparatus drive completion signal outputted in accordance with the operational sequence for controlling the printer, the control circuit 7 stops the power input to the exciter coil 4 of exciter coil assembly 30 from the high frequency power source 3, and also, turns off the first driving power source 14 to stop the rotational driving of the fixation roller 6. Also, the control circuit 7 activates the second driving power source 8 to rotate in steps the magnetic flux blocking member drive gear G2 180° to move the magnetic flux blocking member 5 from the second position in FIG. 4(*b*) to the first position, or the home position, in FIG. 4(*b*), and retains it in the first position.

(Embodiment 2)

In this embodiment, the first temperature sensor 11 detects the temperature decrease as well as the excessive temperature rise, across the portion of the fixation roller corresponding to the out-out-sheet-path range C, and the control circuit 7 controls the driving mechanism 8 in response to the signals reflecting the detected temperature level.

Figure 8:
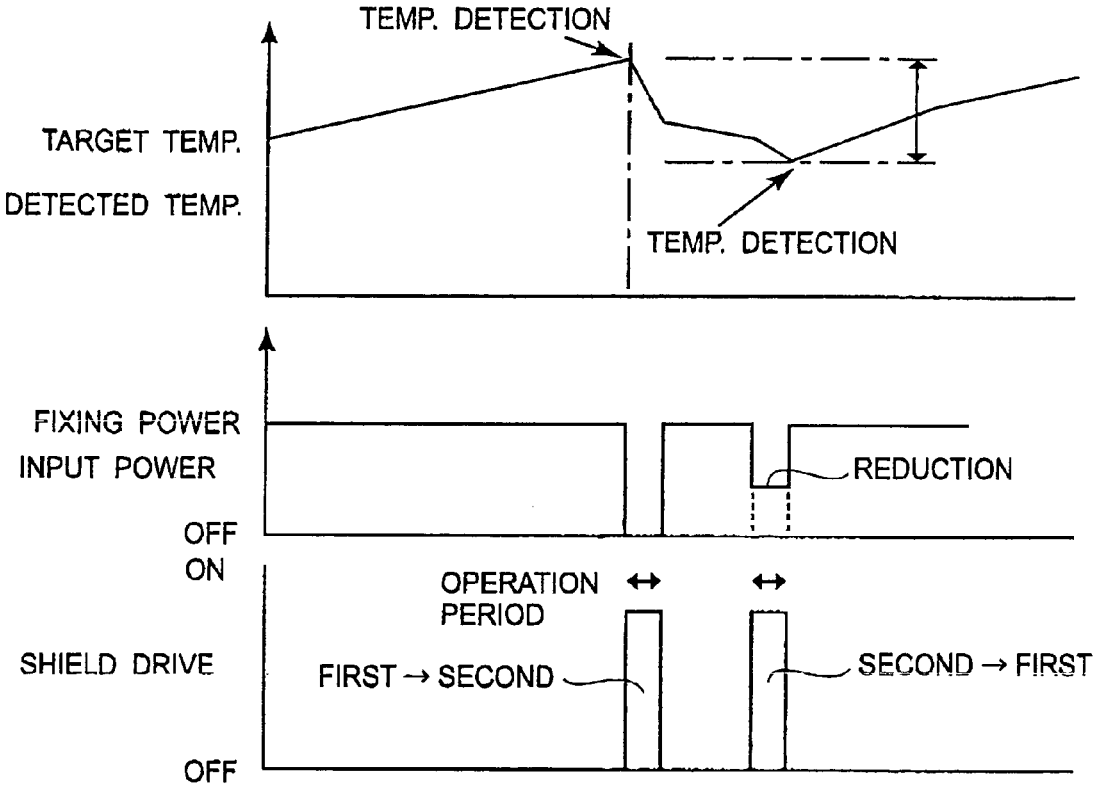
FIG. 8 is the operational sequence of the magnetic flux blocking member in the second embodiment of the present invention.

More specifically, referring to FIG. 8. which shows an operational sequence for moving the magnetic flux blocking member, as the first temperature sensor 11 detects the excessive temperature rise across the portion of the fixation roller 6 corresponding to the out-of-sheet-path range C, the control circuit 7 temporarily reduces the power input to the exciter coil 4 of the exciter coil assembly 30 from the high frequency power source 3, to a level lower than the level optimal for image fixation, or temporarily stop it, and then, activates the second driving power source 8 to rotate in steps the magnetic flux blocking member drive gear G2 180°, moving thereby the magnetic flux blocking member 5 from the first position in FIG. 4(*a*) to the second position in FIG. 4(*b*) to retain it in the second position. As a result, the portion of the fixation roller 6 corresponding to the out-of-sheet-path range C is prevented from being heated by electromagnetic induction, being therefore prevented from excessively increasing in temperature. After the magnetic flux blocking member 5 is moved to the second position, the control circuit 7 restores the power input to the exciter coil 4 of the exciter coil assembly 30 from the high frequency power source 3, to the level optimal for image fixation.

Although shielding the portion of the fixation roller 6 corresponding to the out-of-sheet-path range C can prevent the excessive temperature increase of the portion, it is possible, for example, that the shield of this portion f the fixation roller will cause the temperature of this portion to excessively drops while the amount of the electric power usable for heating is smaller.

In this embodiment, therefore, as the temperature of the portion of the fixation roller 6 corresponding to the out-of-sheet-path range C detected by the first temperature sensor 11 after the moving of the magnetic flux blocking member 5 from the first position to the second position falls to a predetermined low temperature level (temperature level unsuitable for image fixation), the control circuit 7 activates the second driving power source 8 to rotate in steps the magnetic flux blocking member drive gear G2 180° in order to move the magnetic flux blocking member 5 from the second position in FIG. 4(*b*) to the first position in FIG. 4(*a*) to stop shielding the portion of the fixation roller 6 corresponding to the out-of-sheet-path range C from the magnetic flux, while keeping the power input to the exciter coil 4 of the exciter coil assembly 30 from the high frequency power source 3, reduced to a level lower than the level optimal for image fixation, or temporarily stopped. After the magnetic flux blocking member 5 is moved to the first position, the control circuit 7 restores the power input to the exciter coil 4 of the exciter coil assembly 30 from the high frequency power source 3, to the level optimal for image fixation.

With the employment of the above described procedure, the magnetic flux blocking member 5 can be smoothly moved from the second position to the first position to be retained there to increase the temperature of the portion of the fixation roller 6 corresponding to the out-of-sheet-path range C in order to prevent the temperature of this portion from excessively falling.

Regarding the above described control executed by the control circuit 7, as the power supply to the exciter coil 4 is completely stopped to move the magnetic flux blocking member 5, the temperature of the low temperature side of the fixation roller is likely to fall to a level at or below which fixation failure occurs. Therefore, from the standpoint of image fixation efficiency, it is desired that the power supply to the exciter coil 4 is reduced, instead of being stopped, before moving the magnetic flux blocking member 5.

To summarize, according to the operational sequence in this embodiment, the temperature of the fixation roller 6 is constantly detected by the first temperature sensor 11 to keep the temperature of the portion of the fixation roller 6 corresponding to the out-of-sheet-path range C, within a predetermined range, and the power supply from the high frequency power source 3 is controlled while moving the magnetic flux blocking member 5 so that the magnetic flux blocking member 5 can be smoothly moved.

(Embodiment 3)

In this embodiment, the magnetic flux blocking member 5 is moved from the first position to the second position, or from the second position to the first position, in accordance with the paper size information provided by a paper size detecting means 13 (FIG. 6) for detecting the size of the recording medium P fed into the apparatus.

The paper size detecting means 13 is a means for detecting the signal from the cassette from which recording medium P is fed, signal sent from the control panel through which paper size is set, signal sent from a photosensor or an ultrasonic sensor which detects the passage of the recording medium P, or the like signals, in other words, the signals transmitted in an ordinary image forming apparatus. The control circuit 7 controls the driving mechanism 8 in accordance with the paper size signal, in addition to the aforementioned information.

In other words, when the magnetic flux blocking member 5 is in the first position, the control circuit 7 keeps the magnetic flux blocking member 5 in the current position, in response to the information about the size of the recording medium P inputted from the paper size detecting means 13 indicating that a recording medium P of the largest size is fed. However, when the magnetic flux blocking member 5 is in the second position, the control circuit 7 moves the magnetic flux blocking member 5 to the first position, in response to the information about the size of the recording medium P inputted from the paper size detecting means 13 indicating that a recording medium P of the largest size is fed. Further, when the magnetic flux blocking member 5 is in the second position, the control circuit 7 keeps the magnetic flux blocking member 5 in the current position, in response to the information about the size of the recording medium P inputted from the paper size detecting means 13 indicating that a recording medium P of the smaller size is fed. However, when the magnetic flux blocking member 5 is in the first position, the control circuit 7 moves the magnetic flux blocking member 5 to the second position, in response to the information about the size of the recording medium P inputted from the paper size detecting means 13 indicating that a recording medium P of the smaller size is fed, in order to prevent the excessive out-of-sheet-path temperature increase.

Figure 9:
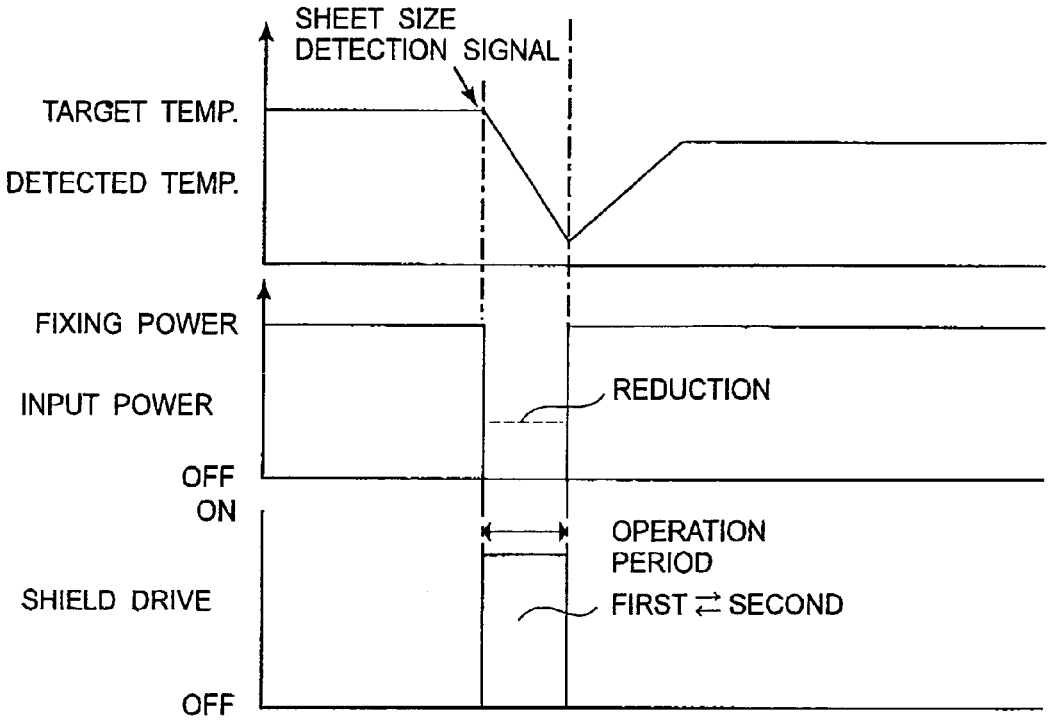
FIG. 9 is the operational sequence of the magnetic flux blocking member in the third embodiment of the present invention.

More specifically, the magnetic flux blocking member 5 is moved from the first position to the second position, or from the second position to the first position, after a control is executed so that the power supply to the exciter coil 4 of the exciter coil assembly 30 from the high frequency power source 3 is temporarily reduced to the level lower than the level optimal for image fixation, or is temporarily stopped, following the operational sequence for moving the magnetic flux blocking member shown in FIG. 9. With the employment of this procedure, the magnetic flux blocking member 5 is moved under the condition in which the electromagnetic force which attracts or repels the magnetic flux blocking member 5 has been eliminated. Therefore, the magnetic flux blocking member 5 can be smoothly moved.

After the magnetic flux blocking member 5 is moved to the first position or second position, the control circuit 7 restores the power supply to the exciter coil 4 of the exciter coil assembly 30 from the high frequency power source 3, to the level optimal for image fixation.

To summarize, according to this embodiment of the present invention, the size of the recording medium P to be next conveyed through the fixating apparatus is detected by the paper size detecting means 13. When the recording medium P is of a smaller size, the power supply to the exciter coil 4 of the exciter coil assembly 30 is reduced, or completely stopped, before the portion of the fixation roller 6 corresponding to the out-of-sheet-path range C excessively rises. Then, the magnetic flux blocking member 5 is moved. With the employment of this operational procedure, the size of the paper which is going to be fed into the fixing apparatus can be always known before the temperature of the portion of the fixation roller 6 corresponding to the out-of-sheet-path range C excessively rises. Therefore, the magnetic flux blocking member 5 can be smoothly moved before the excessive temperature rise occurs.

(Embodiment 4)

Figure 10:
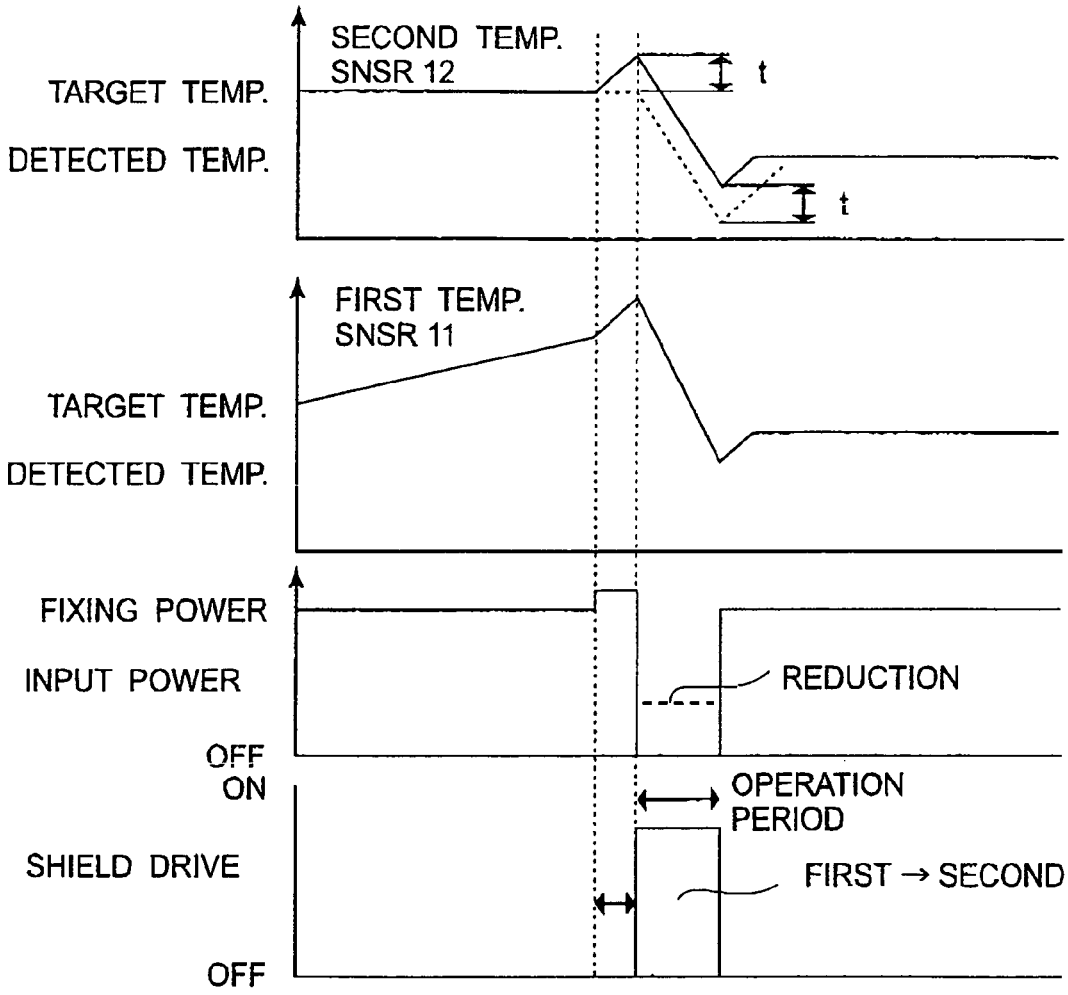
FIG. 10 is the operational sequence of the magnetic flux blocking member in the fourth embodiment of the present invention.

FIG. 10 is a drawing showing the operational sequence, in this embodiment, for moving the magnetic flux blocking member. In this embodiment, either the excessive temperature rise of the portion of the fixation roller 6 corresponding to the out-of-sheet-path range C is detected by the first temperature sensor 11, or the paper size is detected by the paper size detecting means 13. As the paper size information indicates that a recording medium of a smaller size is fed, the control circuit 7 moves the magnetic flux blocking member 5 to the second position after executing such a control that changes the power supply to the exciter coil 4 of the exciter coil assembly 30 from the high frequency power source 3, in the direction to increase the temperature of the fixation roller 6 controlled in response to the output of the second temperature sensor 12. During this process, the control circuit 7 sends a signal also to the high frequency power source 3 in order to control the power supply from the high frequency power source 3; in other words, the control circuit 7 temporarily reduces the power supply to the exciter coil 4 of the exciter coil assembly 30, to the level lower than the level optimal for image fixation, or temporarily stops the power supply.

For example, as a recording medium P of a smaller size is fed, and therefore, it is determined that the magnetic flux blocking member is to be moved, control is executed so that before the magnetic flux blocking member 5 is moved, the amount of the heat which the fixing apparatus 10 generates is increased from the level optimal for the image fixation period (while magnetic flux blocking member is not moved). In other words, in this embodiment, the power consumption (amount of heat generation) of the fixing apparatus 10 is temporarily increased immediately before moving the magnetic flux blocking member 5. Therefore, it, is possible to prevent the problem that the temperature of the fixation roller 6 falls because the magnetic field is temporarily weakened to smoothly move the magnetic flux blocking member 5.

One of the examples of the method for changing the amount of the heat generated by the fixation roller 6 is to change the target temperature level of the fixation roller 6.

Another example is to change the frequency (power) of the high frequency current supplied to the exciter coil 4, instead of changing the target temperature level for the fixation roller 6. Generally, the amount of the heat generated by the fixation roller 6 is dependent upon the frequency of the current supplied to the exciter coil 4. Therefore, the amount of the heat generated by the fixation roller 6 can be changed by changing the frequency of the current supplied to the exciter coil 4.

Not only can the amount of the heat generated by the fixation roller be controlled by changing the frequency of the high frequency current supplied to the exciter coil 4, but also, by changing the current supplied to the exciter coil 4 or the voltage applied to the exciter coil 4.

After the magnetic flux blocking member 5 is moved to the second position, the control circuit 7 restores the power supply to the exciter coil 4 of the exciter coil assembly 30 from the high frequency power source 3, to the level optimal for image fixation.

In this embodiment, the temperature of the fixation roller 6 is adjusted to a level optimal for image fixation, in response to the temperature information from the second temperature sensor 12. The magnetic flux blocking member 5 is moved after the power supply to the exciter coil 4 of the exciter coil assembly 30 is temporarily reduced, or completely interrupted, as in the first to third embodiments. Thus, there is the possibility that the control of the power supply to the exciter coil 4 will result in the excessive temperature drop across the portion of the fixation roller 6 corresponding to the path of the recording medium P. In this embodiment, therefore, before changing the amount of the power supply to the exciter coil 4 in response to the excessive temperature rise detected by the first temperature sensor 11, or the paper size detected by the paper size detecting means 13, in order to smoothly move the magnetic flux blocking member 5, the target temperature of the fixation roller 6 is raised for a predetermined length of time by a target temperature controlling means 111 for changing the target temperature of the above described temperature controlling means, increasing thereby the temperature of the fixation roller 6 to a level higher than the temperature level detected by the second temperature sensor. With the employment of this procedure, not only can the magnetic flux blocking member 5 be smoothly moved, but also, it is possible to prevent the temperature of the portion of the fixation roller 6, corresponding to the path (range) B of a recording medium of the smaller size, from falling to the level at or below which the fixation process is adversely affected.

(Miscellanies)

1) In the preceding embodiments of the present invention, the fixing apparatuses are of the type that controls the position of the recording medium P relative to a fixing apparatus, in terms of the direction perpendicular to the direction in which the recording medium P is conveyed, with reference to only one of the two edges of the recording medium P parallel to the recording medium conveyance direction. Obviously, the present invention is also compatible with a fixing apparatus in which the position of the recording medium P is controlled with reference to the center line of the recording medium P in terms of the direction perpendicular the recording medium conveyance direction. Such a fixing apparatus is to be provided with a pair of magnetic flux blocking members, which are to be positioned on the rear and front side, one for one, to prevent the excessive out-of-sheet-path temperature increase.

2) Also in the preceding embodiments, the fixing apparatuses are enabled to handle only two kinds of recording mediums in terms of size: a large size and a small size. Obviously, the present invention is applicable to a fixing apparatus, the shape and operation of the magnetic flux blocking member(s) of which are designed to be enable to deal with three or more kinds of recording mediums in terms of size.

3) The preceding embodiments are not intended to limit the choices of the mechanism for moving the magnetic flux blocking member, to those in the preceding embodiments, which is obvious. For example, a mechanism comprising a rack and a pinion, a mechanism comprising a solenoid, a mechanism comprising a rod in the form of a worm, a mechanism comprising a pantograph, and the like mechanism, may be employed as the mechanism for moving the magnetic flux blocking member.

4) The structure of the fixing apparatus (heating apparatus) of an electromagnetic induction type does not need to be limited to one of the structures in the preceding embodiments, which is obvious.

Figure 11:
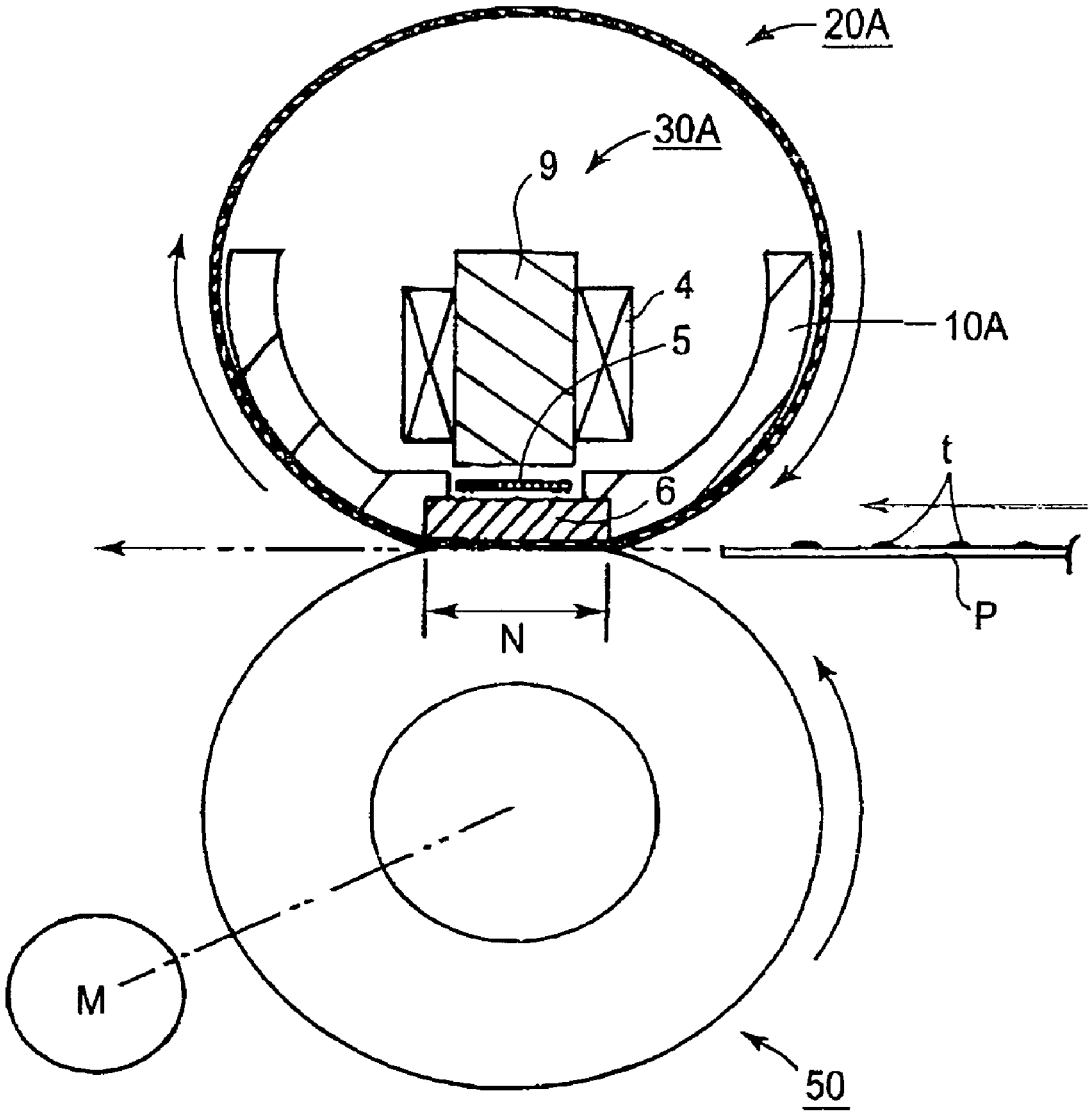
FIG. 11 is a schematic drawing of another thermal image fixing apparatus, showing the general structure thereof.

FIG. 11 shows one of the examples of the structure for a fixing apparatus (heating apparatus) of an electromagnetic induction type. In the case of this structure, the electrically conductive member as a heating member of the fixing apparatus is made stationary, and a recording medium as an object to be heated is heated by this stationary conductive member, with a fixation film interposed between the recording medium and stationary conductive member. In other words, the fixing apparatus shown in FIG. 11 is of both an electromagnetic induction heating type and film heating type.

Designated by a referential symbol 20A is a fixation film assembly as a first fixing member, and designated by a referential number 50 is an elastic pressure roller as a second fixing member. The first and second fixing members 20 and 50 are vertically stacked in parallel to each other, being kept pressed against each other to form the fixation nip N.

The fixation film assembly 20A comprises: a stay 10A in the form of a roughly semicylindrical trough; an electrically conductive member 6 (heat generating member of electromagnetic induction type), as the stationary heating member, which extends in the lengthwise direction of the stay 10A, and is held in the elongated recess cut in the center portion of the external surface of the stay 10A; the combination of an exciter coil 4 and a magnetic core 9, as a magnetic field generating means, held in the hollow of the stay 10A; a fixation film 15 formed of heat resistant resin and loosely fitted around the stay 10A; a magnetic flux blocking member 5 movable into the space between the combination of the magnetic field generating means 4 and 9, and conductive member 6; etc.

The conductive member 6 of the fixation film assembly 20A, and the elastic pressure roller 50, are kept pressed against each other, with the fixation film 15 interposed between the conductive member 6 and pressure roller 50, forming thereby the fixation nip N.

The elastic pressure roller 50 is rotationally driven by a diving mechanism M in the counterclockwise direction indicated by an arrow mark in the drawing. As the pressure roller 50 is rotationally driven, the fixation film 15 of the fixation film assembly 20A is rotated by the torque transmitted thereto by the friction between the fixation film 15 and elastic pressure roller 50, with the fixation film 15 sliding, by its internal surface, on the surface of the stationary conductive member 6 as a heating member, while being kept flatly in contact therewith, so that the fixation film 15 rotates around the stay 20A at a predetermined peripheral velocity.

As electric power is supplied to the exciter coil 4 from the high frequency power source, a magnetic field is generated. As a result, heat is generated in the stationary conductive member 6 as a heating member, by this magnetic field (heat is generated by electromagnetic induction). The temperature of the heating member is kept at a predetermined level optimal for image fixation, by an unshown temperature control system.

As the elastic pressure roller 50 is rotated, the recording medium P bearing an unfixed toner image t is introduced and conveyed between the fixation film 15 and elastic pressure roller 50, in the fixation nip N, along with the fixation film 15, with the surface of the recording medium, which is bearing the unfixed toner image, kept airtightly in contact with the outwardly facing surface of the fixation film 15.

While the recording medium P is conveyed through the fixation nip N, the recording medium P is heated by the heat transmitted thereto, through the fixation film 15, from the stationary conductive member 6 as a heating member. As a result, the unfixed toner image t on the recording medium P is fixed to the surface of the recording medium P by the heat and pressure. Thereafter, the recording medium P becomes separated from the outwardly facing surface of the fixation film 15 due to the curvature of the fixation film 15 (stay 20A), and then, is further conveyed to be discharged from the image forming apparatus.

The magnetic flux blocking member 5 is inserted into the space between the combination of the magnetic field generating means 4 and 9, and conductive member 6, by a magnetic flux blocking member moving mechanism, from the lengthwise end(s) or the stay 10A, in the direction perpendicular to the drawing. When it is necessary to prevent the excessive out-of-sheet-path temperature increase, the control circuit inserts the magnetic flux blocking member 5 into the space between the combination of the magnetic field generating means 4 and 9, and conductive member 6, to shield the portion of the conductive member 6 corresponding to the out-of-sheet-path range, from the magnetic field. When a recording medium of the maximum size is fed, the control circuit pulls the magnetic flux blocking member 5 out of the aforementioned space to stop shielding the out-of-sheet path portion of the conductive member 6 from the magnetic field.

Also in this case, when it is necessary to move the magnetic flux blocking member 5, the magnetic flux blocking member 5 is moved after the power supply to the exciter coil 4 is temporarily reduced, or temporarily stopped, to create the condition in which the electric magnetic force which works in the direction to attract or repel the magnetic flux blocking member 5 is so small that it does not interfere with the movement of the magnetic flux blocking member 5, or does not exist. Therefore, the magnetic flux blocking member 5 can be smoothly moved.

5) The application of the present invention is not limited to such a heating apparatus of an electromagnetic induction type as those thermal image heating apparatuses in the preceding embodiments. In other words, the present invention is applicable to a wide range of means and apparatuses for heating an object in the form of a sheet, for example, an image heating apparatus for heating a recording medium bearing an image, to improve the image in terms of surface properties such as glossiness, an image heating apparatus for temporary fixation, a heating apparatus for drying an object in the form of a sheet, a thermal laminating apparatus, etc.

As described above, according to the present invention, the magnetic flux blocking member, as a magnetic flux controlling member, of a heating apparatus of an electromagnetic induction type can be smoothly moved.

When it is necessary to move the magnetic flux blocking member, control is executed to weaken the magnetic field generated by the magnetic field generating means, to a level lower than the level optimal for heating an object, or to prevent the magnetic field generating means from generating a magnetic field. Therefore, the electric magnetic force (electromagnetic attraction, or electromagnetic repellence) which works between the magnetic flux blocking member movable in the space between the magnetic field generating means and conductive member as a heating member, and the magnetic field generating means, is reduced or eliminated, preventing thereby the problem that the magnetic flux blocking member is caused by the strong electromagnetic force to come into contact with the magnetic field generating means, or the conductive member as a heating member, which is located very close to the magnetic flux blocking member. Therefore, the magnetic flux blocking member can be smoothly moved.

Further, since the magnetic flux blocking member can be smoothly moved, the torque necessary to move the magnetic flux blocking member is smaller. making it possible to reduce the size of the motor for moving the magnetic flux blocking member. Therefore, it is possible to conserve energy. In addition, it is possible to reduce the effect of the eddy current induced in the magnetic flux blocking member, which is the essential source of the electromagnetic force, upon the control of the high frequency driving power source.

In many cases, the magnetic flux blocking member is moved in accordance with the size or the object to be heated, or the number of the object continuously conveyed through a heating apparatus to be heated. Further, the time it takes to move the magnetic flux blocking member is very short, that is, no more than one or two seconds. Thus, even if the magnetic field generated by the magnetic field generating means is kept at a weakened level, or eliminated, while the magnetic flux blocking member is moved, such an adverse effect that the temperature of the conductive member, as a heating member, excessively drops because of the weakening, or elimination, of the magnetic field, or the like effect, does not occur, in practical terms.

Moving the magnetic flux blocking member while the strength of the magnetic field generated by the magnetic field generating means is kept at a level lower than the level optimal for heating an object, instead of eliminating the magnetic field, reduces the amount by which the temperature of the conductive member, as a heating member, falls while the magnetic flux blocking member is moved. Therefore, from the standpoint of the efficiency with which an object is heated, and quality of fixation, reducing the strength of the magnetic field instead of stop generating a magnetic field is advantageous. However, moving the magnetic flux blocking member while a magnetic field is not generated by the magnetic field generating member makes it possible to completely eliminate the effect of the electromagnetic force upon the magnetic flux blocking member, making it thereby possible to more reliably move the magnetic flux blocking member.

While the invention has been described with reference to the structures disclosed herein, it is not confined to the details set forth, and this application is intended to cover such modifications or changes as may come within the purposes of the improvements or the scope of the following claims.

What is claimed is:

1. A heating apparatus comprising:

magnetic field generating means for generating a magnetic field having an intensity which changes with time;

a heat generation member for generating heat by the magnetic field generated by said magnetic field generating means, said heat generation member being effective to heat an image on a recording material;

a magnetic field suppressing member for suppressing the magnetic field from said magnetic field generating means to the heat generation member;

moving means for moving said magnetic field suppressing member into a gap between said magnetic field generating means and a heat generating portion where the magnetic field generated by said magnetic field generating means substantially acts on said heat generation member; and magnetic field control means for controlling an effective magnetic field generated by said magnetic field generating means, wherein said magnetic field control means controls the effective magnetic field generated by said magnetic field generating means in accordance with a moving operation, during a heating operation for the recording material, of said magnetic field suppressing member.

2. An apparatus according to claim 1, wherein said magnetic field control means prevents generation of the magnetic field of said magnetic field generating means during the moving operation of said magnetic field suppressing member.

3. An apparatus according to claim 1, wherein said magnetic field suppressing member is an electroconductive member.

4. An apparatus according to claim 1, wherein said moving means moves said magnetic field suppressing member in accordance with a size of the material to be heated.

5. An apparatus according to claim 1, wherein said moving means inserts said magnetic field suppressing member into the gap or retracts the magnetic field suppressing member therefrom, and wherein said magnetic field control means makes the effective magnetic field more intensive than when said magnetic field suppressing member is retracted from the gap than when said magnetic field suppressing member is inserted into the gap.

6. An apparatus according to claim 1, wherein said magnetic field control means makes the effective magnetic field less intensive when said suppressing means is moving than when said suppressing is at rest.

* * * * *

UNITED STATES PATENT AND TRADEMARK OFFICE

CERTIFICATE OF CORRECTION

PATENT NO. : 6,969,833 B2
DATED : November 29, 2005
INVENTOR(S) : Hitoshi Suzuki It is certified that error appears in the above-identified patent and that said Letters Patent is hereby corrected as shown below:

Column 4,
Line 54, "of" (2nd occurrence) should read -- on --.

Column 10,
Line 52, "filed" should read -- field --.

Column 11,
Line 31, "execute" should read -- executes --.

Column 12,
Line 27, "time" should read -- times --.
Line 67, "completion" should read -- complete --.

Column 13,
Line 67, "f" should read -- of --.

Column 14,
Line 2, "drops" should read -- drop --.

Column 17,
Line 43, "enable" should read -- able --.

Signed and Sealed this

Sixth Day of June, 2006

JON W. DUDAS
*Director of the United States Patent and Trademark Office*